US009514589B2

(12) United States Patent
Raina et al.

(10) Patent No.: US 9,514,589 B2
(45) Date of Patent: Dec. 6, 2016

(54) SECURE SHORT-DISTANCE-BASED COMMUNICATION AND ACCESS CONTROL SYSTEM

(71) Applicant: Accenture Global Services Limited, Dublin (IE)

(72) Inventors: Sunil Raina, Issaquah, WA (US); Avishek Somani, Toronto (CA); Alden Cuddihey, Kanata (CA); Scott Thomas Butler, Oakville (CA); Douglas Arthur Michael Archibald, Kanata (CA)

(73) Assignee: ACCENTURE GLOBAL SERVICES LIMITED, Dublin (IE)

( * ) Notice: Subject to any disclaimer, the term of this patent is extended or adjusted under 35 U.S.C. 154(b) by 16 days.

(21) Appl. No.: 14/468,188

(22) Filed: Aug. 25, 2014

(65) Prior Publication Data

US 2016/0055689 A1 Feb. 25, 2016

(51) Int. Cl.

| | |
|---|---|
| ***G08B 29/00*** | (2006.01) |
| ***G07C 9/02*** | (2006.01) |
| ***G07C 9/00*** | (2006.01) |

(52) U.S. Cl.

CPC ..... *G07C 9/025* (2013.01); *G07C 9/00309* (2013.01); *G07C 2009/00412* (2013.01)

(58) Field of Classification Search

CPC ... G07C 9/00; G07C 9/00007; G07C 9/00015; G07C 9/00023; G07C 9/00031; G07C 9/00039; G07C 9/00103; G07C 9/00111; G07C 9/00119; G07C 9/00174; G07C 9/00309; G07C 9/00571; G07C 9/00817; G07C 9/00857; G07C 9/02; G07B 15/00; G07B 15/04

See application file for complete search history.

(56) References Cited

U.S. PATENT DOCUMENTS

| | | | | |
|---|---|---|---|---|
| 5,485,347 | A | 1/1996 | Miura | |
| 7,255,264 | B2 * | 8/2007 | De Leon | G06Q 20/145 235/375 |
| 7,567,920 | B2 * | 7/2009 | Hammad | G06Q 20/32 705/13 |

(Continued)

FOREIGN PATENT DOCUMENTS

| | | |
|---|---|---|
| CN | 104392501 | 3/2015 |
| CN | 105243689 | 1/2016 |

(Continued)

OTHER PUBLICATIONS

"The extended European search report" on EP patent application No. 15196185.1, European Patent Office, dated Feb. 22, 2016, 7 pages.

(Continued)

*Primary Examiner* — Ryan Sherwin
(74) *Attorney, Agent, or Firm* — Mannava & Kang, P.C.

(57) ABSTRACT

A secure short-distance-based communication and access control system controls access to a restricted area. A run-time mobile device identifier and keys that may be location-specific, device-specific and time-specific are generated and utilized for secure communication between mobile devices and zone computers. The zone computers can validate users via their mobile devices to allow or deny access to the restricted area.

22 Claims, 9 Drawing Sheets

(56) References Cited

U.S. PATENT DOCUMENTS

| | | | | |
|---|---|---|---|---|
| 7,731,086 | B2 * | 6/2010 | Saunders | G06Q 20/10 235/380 |
| 8,326,221 | B2 | 12/2012 | Dorsey | |
| 8,369,842 | B2 | 2/2013 | Proctor, Jr. | |
| 8,781,502 | B1 | 7/2014 | Middleton et al. | |
| 8,856,916 | B1 * | 10/2014 | Sobel | G06F 12/14 726/17 |
| 9,204,257 | B1 | 12/2015 | Mendelson | |
| 2001/0045886 | A1 * | 11/2001 | Minowa | H04W 84/022 340/7.45 |
| 2005/0070257 | A1 | 3/2005 | Saarinen et al. | |
| 2005/0093697 | A1 | 5/2005 | Nichani | |
| 2005/0233789 | A1 | 10/2005 | Maekawa | |
| 2006/0214815 | A1 | 9/2006 | Komatsu | |
| 2006/0242908 | A1 | 11/2006 | McKinney | |
| 2007/0276765 | A1 * | 11/2007 | Hazel | G06F 21/72 705/71 |
| 2010/0066503 | A1 | 3/2010 | Rhie et al. | |
| 2011/0137773 | A1 | 6/2011 | Davis, III | |
| 2011/0153495 | A1 | 6/2011 | Dixon et al. | |
| 2012/0235812 | A1 | 9/2012 | Maia et al. | |
| 2012/0254040 | A1 | 10/2012 | Dixon et al. | |
| 2013/0090134 | A1 | 4/2013 | Heshmati | |
| 2013/0165157 | A1 | 6/2013 | Mapes | |
| 2013/0322674 | A1 * | 12/2013 | Ren | H04S 7/303 381/337 |
| 2014/0095227 | A1 | 4/2014 | Parker et al. | |
| 2014/0273857 | A1 | 9/2014 | White et al. | |
| 2014/0344036 | A1 | 11/2014 | Serad | |
| 2015/0042451 | A1 * | 2/2015 | Matsumoto | G01C 21/165 340/5.61 |
| 2015/0120558 | A1 | 4/2015 | Andrews | |
| 2015/0289207 | A1 | 10/2015 | Kubo | |
| 2015/0289295 | A1 | 10/2015 | Granbery | |
| 2016/0007184 | A1 | 1/2016 | Kulikov | |
| 2016/0019726 | A1 | 1/2016 | Joy et al. | |
| 2016/0044460 | A1 | 2/2016 | Cornaby | |
| 2016/0073264 | A1 | 3/2016 | Van den Broeck | |
| 2016/0087959 | A1 | 3/2016 | Park | |

FOREIGN PATENT DOCUMENTS

| | | |
|---|---|---|
| WO | 2015100185 | 7/2015 |
| WO | 2015123378 | 8/2015 |

OTHER PUBLICATIONS

Radius Networks, "How to Pop a Pass Using iBeacon Technology", http://developer.radiusnetworks.com/blog/ Downloaded on Nov. 28, 2015, 19 pages.

Masabi, "Transport Operators and Barcode M-Ticketing", London, UK, download date Oct. 28, 2015. http://www.masabi.com/wp-content/uploads/2011/02/Transport-Operators-and-Barcode-mTicketing.pdf.

HopOn, "HopOn Beacon", download date Oct. 28, 2015, 9 pages. http://hopon.co/technology/.

Two Canoes, "Bleu Meetings", download date Oct. 28, 2015, 5 pages. http://twocanoes.com/products/online-services/bleu-meetings.

MTA, "LIRR Seeking Development of Train Ticketing App", Jan. 26, 2013, 2 pages. http://www.mta.info/news/2013/01/26/lirr-seeking-development-train-ticketing-app.

Intercom, "How Mobile Ticket delivery works?", download date Oct. 29, 2015, 3 pages. http://www.intercom.ee/mobile-ticketing-works.

"The Partial European search report", European Patent Application No. 15182143.6, European Patent Office, dated Jan. 21, 2016, 7 pages.

* cited by examiner

SECURE SHORT-DISTANCE-BASED COMMUNICATION AND ACCESS CONTROL SYSTEM

BACKGROUND

For a variety of situations and reasons, it may be desirable to control people's access to an area of interest. For example, it is not uncommon to include a gate to block entrance to a parking lot or secured facility. In another example, mass transit systems, such as subways, often include some form of entrance control to enforce fare payment to ride the subway. Also, other places, like concert halls, stadiums, etc., still have conventional paper tickets, and people are employed to physically validate each individual ticket.

Controlling access to these areas is often automated. For example, a user has a card key, and a reader is installed at a gated entrance. To gain access to the area, the user inserts his card key into the reader or places it in very close proximity to the reader so the reader can read the card key. The information transmitted from the card key may be an ID and/or other information for the user and is processed through appropriate business rules to determine if the user is authorized to access the area. If the user is determined to be authorized, the gate is opened and the user is allowed access. In some systems, additional or different determinations are made to determine whether a user is granted access to the restricted area. For example, for mass transit systems, a determination is made as to whether the user has paid a fare or has sufficient funds in an account to pay a fare so it may be deducted after the user travels on the mass transit system.

It is a major inconvenience for the user to have to carry an additional card key and physically present the card key to the reader to gain access to the restricted area. To manufacture and disseminate the card keys for the systems is an expense. Furthermore, the security of conventional systems is not optimal. In conventional systems, security codes used to validate the card keys are often stored on readers, and encoded into the card keys. They are highly susceptible to hacking and as a result create a vulnerability of providing unauthorized access to restricted areas.

BRIEF DESCRIPTION OF DRAWINGS

Features of the present disclosure are illustrated by way of examples shown in the following figures. In the following figures, like numerals indicate like elements, in which.

DETAILED DESCRIPTION

Figure 1:
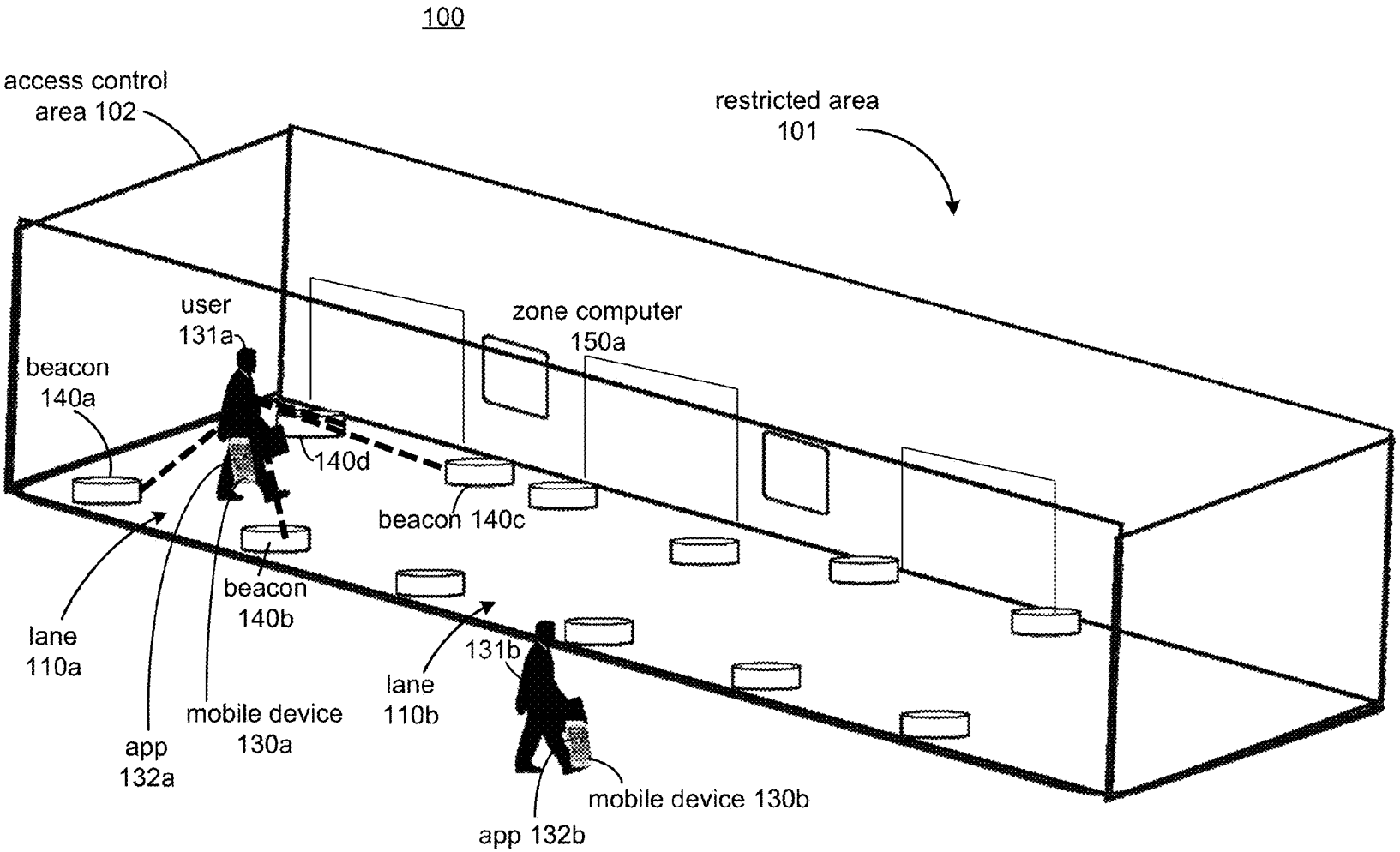
FIG. 1 illustrates a secure short-distance-based communication and access control system, according to an example of the present disclosure.

For simplicity and illustrative purposes, the present disclosure is described by referring mainly to examples thereof. In the following description, numerous specific details are set forth in order to provide a thorough understanding of the present disclosure. It will be readily apparent however, that the present disclosure may be practiced without limitation to these specific details. In other instances, some methods and structures have not been described in detail so as not to unnecessarily obscure the present disclosure.

Throughout the present disclosure, the terms "a" and "an" are intended to denote at least one of a particular element. As used herein, the term "includes" means includes but not limited to, the term "including" means including but not limited to. The term "based on" means based at least in part on.

A secure short-distance-based communication and access control system controls access to a geographic area. The system may be employed in an entry to a restricted area to control physical access to the area. The system employs low-powered beacons, such as Bluetooth beacons, IBEACON, Bluetooth enabled computers running an application in peripheral mode, a Bluetooth tag acting as a peripheral or the like, and zone computers at multiple sub-locations associated with accessing the restricted area. Individuals communicate through their mobile devices, which can execute an application for validation, such as fare payment, with the beacons and the zone computers to gain access to the restricted area. The system includes mechanical barriers that are actuated in response to electronic authentication and validation of an individual to allow access to the restricted area. In one example, the sub-locations are fare gate lanes. For example, as an individual walks into the restricted area, their mobile device will determine its location, for example, from beacons signals in its current vicinity and engage in validation with a local zone computer if the mobile device determines it is in an area of validation for the local zone computer. For example, the user's mobile device may use the beacons to verify the position of user, and once the position is verified, enable interaction with the correct zone computer to validate the user and open the gate. In another example, the zone computer may use the beacons to verify the position of the user, and once the position is verified, enable the local zone computer to initiate interaction with the mobile device to validate the user and open the gate.

The system facilitates secure communication through short-distance-based communication between the mobile devices and the zone computers and through on-the-spot unique identifiers generated by the mobile devices. The unique identifiers enable the secure communication between the mobile devices and the zone computers. Each unique identifier may be generated for a specific mobile device at its current location proximal to a zone computer. Unique identifiers may be determined or derived or calculated or computed from signals or broadcast packets received from the beacons for the current location of the mobile device. For example, the unique identifiers are unique to the current location and time of the mobile device when it transmits the unique identifiers to the zone computer associated with the sub-location where the mobile device is located. Also, a user's existing mobile device may be employed to gain access to the restricted area. For example, an access control application is loaded on the user's mobile device to enable access to the restricted area. Short-distance-based communication for message exchange between the mobile device and a zone computer is employed by the system so the user does not need to physically place a card key on a reader to access the restricted area. Instead, the mobile device may remain in the user's pocket or bag and engage in activation and validation processes with the zone computer and other external computers if needed to gain access to an area. Additionally, the system may include multiple lanes of access to the restricted area that are in close proximity but the system employs techniques to minimize or prevent cross-talk between mobile devices and zone computers in the multiple lanes to facilitate secure message exchange and validation of multiple users simultaneously in different lanes of entrance to the restricted area. The messages exchanged between the mobile device and the zone computer may be encrypted or enciphered or MACed using one or more encryption keys valid only for the current sub-location, mobile device and time. Also, an application running on the mobile device that facilitates security and other functions can easily be remotely updated over a network. However, smartcards do not support this feature. The secure communication, cross talk minimization, and application updating of the secure short-distance-based communication and access control system represent significant technical advantages over existing area access control systems.

FIG. 1 illustrates a secure short-distance-based communication and access control system 100, referred to as the system 100. The system 100 is employed at an access control area 102 for a restricted area 101. The restricted area 101 may be a geographic area or location. The geographic area may be a building, a room in a building, an area in an outdoor environment, or any geographic area that may be physically located in a physical structure, which may be stationary or mobile. The area 101 is referred to as "restricted" because access to the area is controlled by the system 100. The access control area 102 is the geographic area where access to the restricted area 101 is controlled by the system 100. For example, the access control area 102 is located at an entrance or exit to the restricted area 101. Controlling access to the restricted area 101 may include controlling entry to the restricted area 101 and/or exiting from the restricted area 101. Furthermore, the access control area 102 may be divided into a plurality of sub-locations, such as lanes 110, where validation occurs to allow or deny access to the restricted area 101. The plurality of sub-locations allows multiple users to be validated simultaneously.

The system 100 controls access to the restricted area 101 by authenticating and validating users trying to gain access to the restricted area 101. User refers to anyone or anything trying to gain access to the restricted area 101. Also, the system 100 may include or control physical barriers that are actuated or not actuated to allow or deny access to the restricted area depending on whether a user is authenticated and validated. Also, the system 100 is generally described as used at an entrance to the restricted area 101, but the system may be used at an exit to the restricted area or other locations.

The system 100 may include end user mobile devices 130 that can each run an access control application 132 to exchange information with beacons 140 and zone computers 150 to facilitate access control for the restricted area 101. The mobile devices 130 may include mobile devices 130*a* and 130*b* shown for users 131*a* and 131*b* respectively to illustrate that users can use mobile devices to gain entry to the restricted area 101. Of course, any number of individuals using mobile devices may be validated by the system 100 to gain access to the restricted area 101. Also, multiple beacons (like Bluetooth beacons, IBEACONS, Wi-Fi access points, etc.) 140, including beacons labeled 140*a-d*, and multiple zone computers 150, including zone computers labeled 150*a-b*, are shown, however, any number of beacons and zone computers may be included in the system 100 depending on various factors, such as how many users need to be processed simultaneously to control access to the restricted area 101. Each zone computer may be associated with a different sub-location in the access control area 102.

The beacons 140 are hardware that can broadcast beacon signals. The beacons 140 may be standalone devices or incorporated into another system. A zone computer may have a beacon. The beacons 140 broadcast beacon signals at a short distance, such as up to 10 meters or a much shorter distance, such as up to 4 centimeters. For example, the beacons 140 may be Bluetooth, Bluetooth Low Energy, or near-field communication beacons, or Wi-Fi and the range of each of these type of communication protocols is described below. The beacons 140 may be part of a local positioning system, such as IBEACONS, that are used to wirelessly determine the position of the mobile devices 130 inside the restricted area 101.

The mobile devices 130 may be any computer that a user may carry and that can run applications including the access control applications 132. Examples of the mobile devices 130 include mobile phones, tablets, wearable computers, such as GOOGLE glass or smart devices embedded into clothing, a smart watch, fitness tracker, or wireless enabled shoes, or some other type of mobile computer. The mobile devices 130 may include short-distance wireless communication interfaces that can wirelessly communicate with beacons 140 and zone computers 150 when in proximity to the beacons 140 and the zone computers 150. Also, in addition to receiving signals from the beacons 140, the mobile devices 130 themselves may operate as a beacon and broadcast a beacon signal or act as a peripheral, enabling services and/or characteristics, or act as a central and start searching for peripherals with certain services and/or characteristics and/or name and/or other unique identifiers. The mobile devices 130 may include a beacon. In one example, a short-distance communication interface in a mobile device can broadcast a beacon signal to initiate communication with a local zone computer as is further described below, and the beacon signal is dynamically generated. In one example, the short-distance wireless communication interfaces may include near-field communication (NFC) interfaces. NFC is a set of standards for smartphones and other mobile devices to establish radio communication with each other and other computers by touching them together or bringing them into close proximity. The close proximity may be a few inches or few centimeters (e.g., 4 centimeters). Other wireless interfaces may be used. For example, Bluetooth may be used and has a longer range, but may consume more battery power and is more susceptible to cross talk. In another example, Bluetooth Low Energy (BLE) or Bluetooth 4.0 or future versions of Bluetooth wireless interfaces may be used. BLE is a wireless technology that is intended to provide reduced power consumption when compared to Bluetooth but has a similar range to Bluetooth. The components of the system 100 may have one or multiple types of short-distance wireless interfaces, which may have ranges from a few centimeters to a few meters. In another example, the range is up to 100 feet. The zone computers 150 and beacons 140 include wireless interfaces to communicate with the mobile devices 130 and other computers as needed. As described above, examples of the wireless interfaces may include near field communication interfaces, Bluetooth communication interfaces and/or BLE communication interfaces but other short-distance wireless interfaces may be used. The zone computers 150 and mobile devices 130 may utilize other communication interfaces as well, which are wired or wireless and may be network interfaces, but communication between the beacons 140 and the mobile devices 130 and communication between the zone computers 150 and the mobile devices 130 for the system 100 may rely on short-distance wireless interfaces for communication with each other. The mobile devices 130 include a short-distance interface that matches the beacons signals broadcast from the beacons 140. So if the beacons 140 broadcast Bluetooth signals, the mobile device 130 at least include a Bluetooth interface to receive the signals, and so on.

The zone computers 150 validate the users 131 through their mobile devices 130. The zone computers 150 may include beacons but are not required to include the beacons. The zone computers 150 for example are validators. For example, a zone computer may be a fare payment device that can interact with a mobile device to deduct money or otherwise accept payment for a fare.

The beacons 140 may be embedded in a physical infrastructure, such as a housing for a lane-based entry system or a barrier-type infrastructure. The beacons 140 may broadcast a message every x milliseconds (ms), where x>1 ms and may be less than 200 ms but other intervals may be used and the intervals may depend on the environment and use case. The message may be a unique identifier (ID) or a set of unique IDs or a combination of generic IDs and unique IDs. In one example, at least one part of the ID is generic and the other part is unique. In one example, the ID may include a universally unique identifier (UUID) a major ID and/or a minor ID. For example, one of the identifiers is generic (e.g., UUID and/or the major ID) and may be the same for all beacons that belong to or are for a particular entity, such as for the same company or the same mass transit system, or may vary between different entities or restriction level within the same company or mass transit system, like different unique ID between rail, subway and bus, or different unique IDs between different floors within a secured facility. The other unique ID (e.g., minor ID) may help identify a particular location or sub-location. For example, the major ID may be the same for all beacons that belong to a particular location within the system, such as a specific rail station or a bus stop, or vary within the same location, such as different major ID for different entrances in a rail station. The minor ID may be different and unique to the beacon and can be associated with a particular sub-location within a location. For example, a minor ID may be for a particular lane at an entry point.) For example, FIG. 1 shows entrances for lanes 110*a* and 110*b*. one of the unique identifiers (e.g. minor ID) may be different but consecutive for the beacons 140*a-d* because they are for the same lane 110*a* or are for adjacent lanes, but, each beacon has one or more of the unique identifiers that are same (e.g. major ID) because they are for the same entry point, the same rail station and/or belong to the same entity, such as the same mass transit system. In another implementation, the unique identifiers may be assigned using a mathematical function, such that the mobile device or the zone computer can calculate the location and sub-location information from the unique identifiers broadcasted by the nearby beacons.

The mobile devices 130 listen for the broadcasts from the beacons 140, which may contain the unique identifiers for each beacon, or inputs from which the unique identifiers may be calculated or computed or derived or looked up in an internal data store. When a mobile device is in range of one or more of the beacons 140, unique identifiers received from the beacons at the mobile device may invoke a detection mode in the mobile device to determine whether the mobile device is at an entry point controlled by the system 100. For example, the mobile device determines whether it is in an entrance lane, such as the lane 110*a* or the lane 110*b*, for entering the restricted area 101. The unique identifiers, signal strength (such as received signal strength indicator (RSSI), transmission power, and/or received Power) of the beacon's broadcasts, broadcast zone, broadcast accuracy, azimuth and angle of the beacon (e.g., calculated from the received wireless broadcast) help identify the location of the mobile device. If the mobile device detects that it is in an area of validation, such as an entry point controlled by the system, it enables validation mode. This may involve the mobile device getting into a peripheral mode, wherein the mobile device may start sending message broadcasts over the wireless interface (e.g. Bluetooth 4.0), like a beacon. For example, the mobile device acts as a Bluetooth peripheral and advertises, broadcasts, transmits, and/or enables its services and/or characteristics using one or more of the unique IDs calculated above. The zone computer may use the unique IDs to identify the mobile device or the services/characteristics advertised, broadcasted, transmitted, and/or supported by the mobile device or the fare payment application on the mobile device. In another example, the zone computer broadcasts a services message indicating that it is available for validation and the mobile device ID calculated by the zone computer is included in the services message. The mobile device receives the services message, determines whether the mobile device ID in the services message matches the mobile device ID calculated by the mobile device, and if it does match, initiating a message exchange for authentication and validation.

In another example, the establishing of communication between a mobile device and a zone computer may include the zone computer scanning for a mobile device in range. The zone computer checks signal strength, etc. to determine if a mobile device falls within its sub-location. If so, the zone computer connects to the mobile device and then runs a service discovery to check for available services/characteristics of the mobile device. If the zone computer finds the services it is interested in, it continues or else disconnects with the peripheral (i.e., the mobile device). In yet another example, the mobile device determines a name (e.g., a local name) from information in a beacon signal and includes it in information broadcasted from the mobile device. The zone computer receives the broadcast and determines whether it includes the local name. If so, the zone computer determines that the mobile device is to be validated.

The zone computers 150 include computers that may be provided for each entry point or each sub-location at an entry point (e.g., each lane) for authentication and validation of users to access the restricted area 101. A zone computer may support one lane or may support multiple lanes. In one implementation, the zone computers 150 are looking for mobile devices which are broadcasting, advertising, and/or transmitting a specific unique ID or IDs and/or supporting services and/or characteristics with a specific unique ID or IDs, signal strength, location or a combination of them or all. Once a zone computer detects a mobile device that matches the criteria, the zone computer may connect to the mobile device via the wireless interface (e.g. Bluetooth 4.0 or BLE or future versions of Bluetooth, Wi-Fi, etc.) and may begin the authentication process, which may then be followed by the message exchange for validation. The zone computers 150 engage in message exchange and processes with the mobile devices 130 for validation for example after the mobile devices detect that they are at an entry point. For example, after the mobile device detects it is at an entry point or sub-location at an entry point, it may activate payment mode, which then results in a process to be executed to establish a secure communication channel between a mobile device and a zone computer through run-time key generation, which may be based on the unique user credentials, unique IDs of beacons and other information. Validation may include determining whether the user is allowed to enter the restricted area 101. In one example, validation may include fare-based validation, such as when payment of a fare is required to enter or exit the restricted area 101. Detection, secure message exchange and validation are described in detail below. The zone computers 150 may be provided locally at the sub-locations of an entry point. The zone computers 150 may be connected to a back-end server via the Internet or another wide area network to provide updates and perform other functions.

Figure 2:
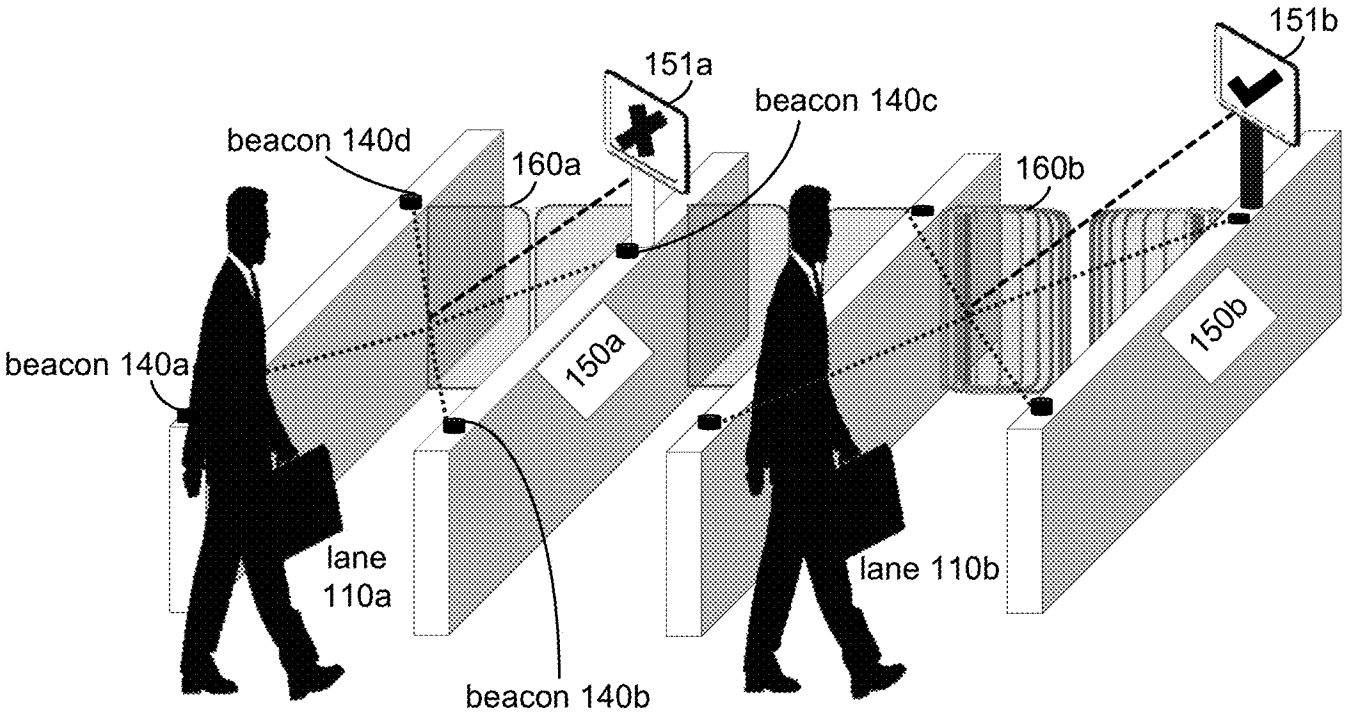
FIG. 2 shows an example of lanes that may be sub-locations of an entry point for a restricted area.

FIG. 2 shows an example of the lanes 110 that may be sub-locations of an entry point for the restricted area 101. As shown in FIG. 2, the beacons 140 and/or the zone computers may be embedded in the physical structures of the lanes 110. The zone computers 150 may electronically control movable physical barriers 160. Each electronically-controlled movable physical barrier may be located in a different sub-location of a plurality of sub-locations of an access control area associated with the restricted area, such as gates 160*a-b*, to allow or deny access to the restricted area 101. Also, the zone computers 150 may be connected to displays 151, such as displays 151*a-b*, to provide indication to the user of whether they are approved to enter the restricted area or not. Other information may also be displayed. For example, an arrow indicates a lane is open. The check mark shown on the display 151*b* indicates a person is validated and the gate opens. If the person is not validated, the display may show an X, such as on display 151*a*, and may provide additional information, such as "See Attendant" or "Insufficient Funds" if the user's account does not have sufficient funds to pay a fare. Also, external systems may be invoked, such as to alert attendants or to automatically replenish funds in a user's account or change user's access privileges.

Figure 3:
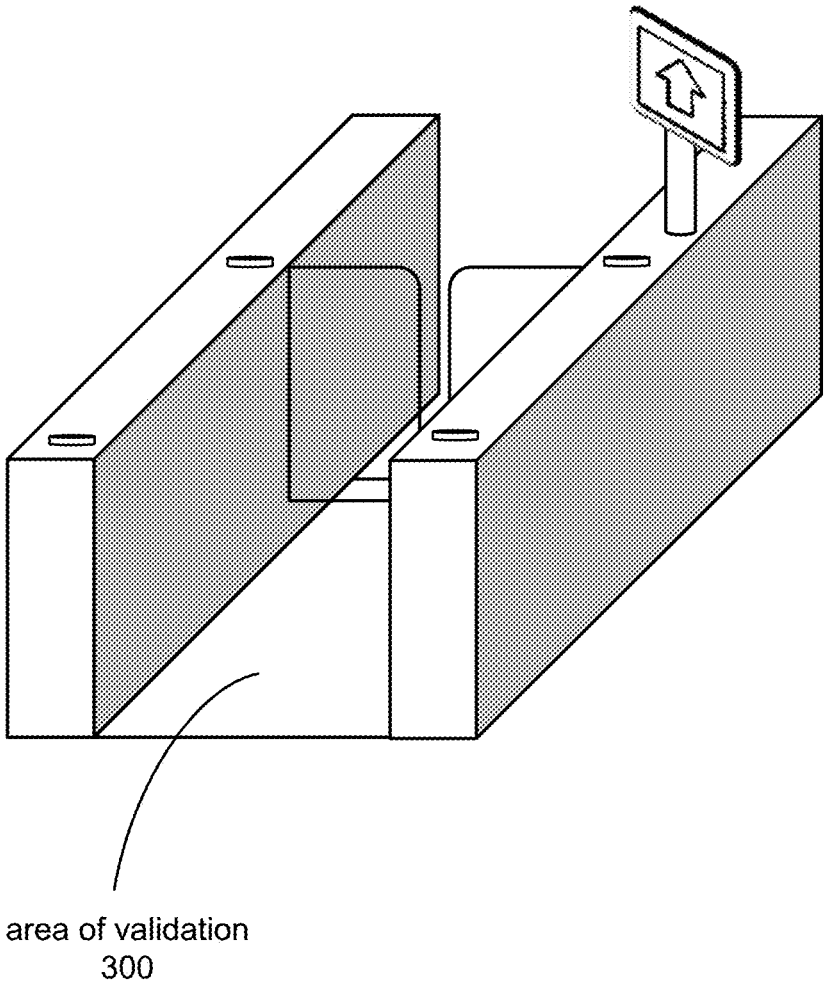
FIG. 3 illustrates an example of an area of validation for a zone computer.

FIG. 3 shows an area of validation 300 for a zone computer. For example, the area of validation is a sub-location, such as one of the lanes 110. A zone computer for the lane may determine whether a mobile device has entered the area of validation, which may be based on triangulation or other techniques. If the zone computer determines the mobile device is in the area of validation, the mobile device is validated to allow entry into the restricted area through the lane and gate. A secure communication channel is established for message exchange between the mobile device and the zone computer to facilitate validation, as is further described below.

Figure 4:
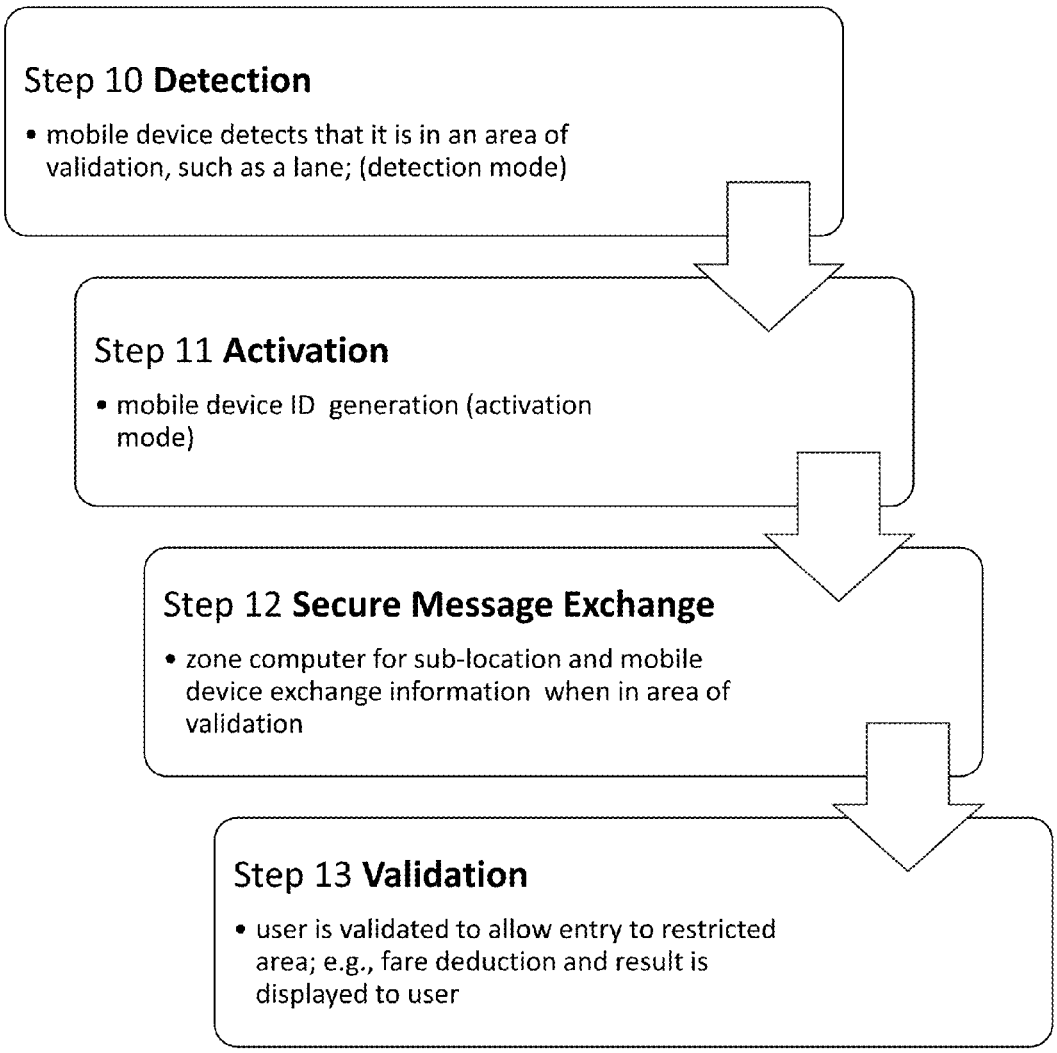
FIG. 4 shows a high-level flow chart of a method performed by the secure short-distance-based communication and access control system, according to an example of the present disclosure.
Figure 5:
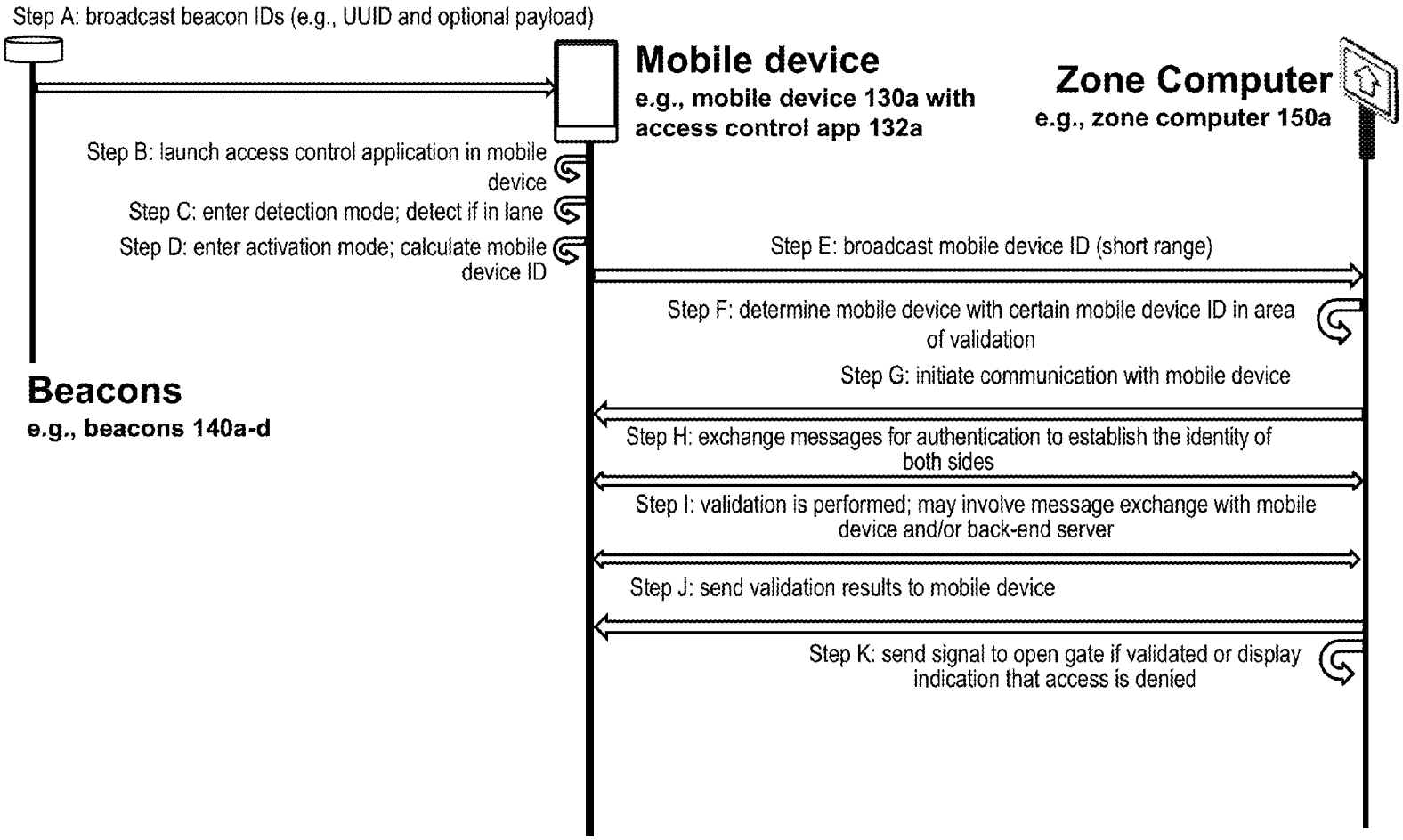
FIG. 5 shows additional details of the steps of FIG. 4, according to an example of the present disclosure.

FIG. 4 shows a high-level flow chart of steps performed by the system 100, and FIG. 5 shows additional details of the steps and the interaction between the various sub-systems of the system 100, including the mobile devices 130, beacons 140, and zone computers 150 that perform the steps according to an embodiment. Referring to FIG. 4, steps are shown for detection at step 10, activation at step 11, exchange at step 12 and validation at step 13.

At step 10, for detection, a mobile device determines whether it is in an area of validation (e.g. proximity to a zone computer for fare payment in a transit system) based on information received from beacons. Determining proximity to a zone computer (e.g., determining whether the mobile device is in the area of validation) may include determining whether the mobile device is within a valid distance to a beacon or a plurality of beacons associated with a zone computer, or determining whether the mobile device is in a sub-location in the entrance area, such as a lane, or an area of validation associated with a zone computer. For example, mobile device 130*a* shown in FIG. 2 receives a unique ID, e.g., including UUID, major ID and minor ID, from at least one of the beacons 140*a-d* when in range of the beacons 140*a-d*. The unique IDs of each beacons may be determined so that it can be used to identify its location, such as station, entrance location and/or lane number. The beacons may also transmit a small payload containing the location information or any other information that can help to calculate the location information.

In one example, triangulation-based detection is performed to determine whether the mobile device 130*a* is in a lane. For example, the access control application 132*a* running on the mobile device 130*a* registers for beacon notifications with a specific unique ID or IDs or part of the IDs, e.g. UUID and/or major ID and/or minor ID or a list of UUIDs and/or major IDs and/or minor IDs. For example, the UUIDs or the major IDs may be the same for all beacons provided by the same entity, such as all beacons for the same mass transit company or all beacons for the same rail station. So, for example, the major IDs in unique IDs broadcasted by the beacons 140 may be the same because they are for the same entity, rail station and/or entrance. The access control application 132*a* stores a list of UUIDs, major IDs and minor IDs that it may respond to. The mobile device 130*a* listens for broadcasted unique IDs from beacons. If the unique IDs of the beacon signals that are received are registered, such as stored in the list, the access control application 132*a* determines whether the mobile device is in an area of validation for a local computer, such as lane 110*a*. For example, in response to recognizing broadcasts from beacons 140*a-d* or at least two of the beacons, using algorithms like triangulation, the access control application 132*a* determines that it is within a predetermined distance (e.g., within 1 meter) to at least 2 of the beacons 140*a-d*. Thus, the access control application 132*a* determines that it is in a lane, such as lane 110*a*, and then proceeds to activation at step 111.

In another example, tap-based detection is performed. For example, the user lightly taps the mobile device 130*a* on or near beacons 140*a* or at zone computer 150*a* if it also acts as a beacon. The range of the beacon may be tuned so that the mobile device 130*a* needs to be in close proximity to detect the beacon, such as within 3-4 centimeters, or the mobile device might take into consideration the signal strength, zone, accuracy and other factors of the beacon broadcast to determine the proximity with the beacons, and decide accordingly. If a beacon unique ID or IDs are received that are registered at the mobile device 130*a*, in response to the tapping or placement in close proximity to the beacon, the access control application 132*a* performs activation at step 11. In another example, an intent of the user to enter validation is determined for example based on measurable user actions performed on the mobile device, such as shaking the mobile device twice, audible command spoken into the mobile device, etc.

At step 11 shown in FIG. 4, during activation, a unique run-time ID or a set of unique run-time IDs are calculated for the mobile device 132*a* for future secure message exchange with the zone computer 150*a*, and a peripheral mode is activated on the mobile device. The mobile device advertises certain service or characteristics or both using the unique ID or IDs calculated above. The peripheral mode is entered to communicate with the zone computer associated with the current location of the mobile device 132*a*, which is zone computer 150*a*. Unique ID determination may vary depending on how detection was performed. For example, if triangulation-based detection was performed, the unique IDs (like major ID, minor ID and optional payload) from the beacons used for triangulation may be used to calculate the unique ID or IDs for the mobile device. If tap-based detection was performed, the unique ID or IDs may be calculated using the unique ID or IDs from the beacon that was tapped (e.g. major ID, minor ID and optional payload from the beacon that was tapped). The peripheral mode is enabled in the mobile device to communicate with the zone computer for the lane using the unique IDs for the services and/or characteristics. Examples of unique ID calculation functions are described below.

In one example, the unique ID or IDs for the mobile device (which may be used to determine the services, such as fare payment, and/or characteristics of the access control application and the mobile device) are calculated using the information received from the beacons and/or zone computer as the input. Thus, the unique ID or IDs are specific to the current location of the mobile device. The unique ID or IDs is not valid (or may not be valid) at a different location.

A unique ID calculation function may be used to calculate the unique ID or IDs for the mobile device from the information received from one or more beacons. An example of a unique ID calculation function is described below. Assume the following: Row=Minor ID/1000; Sequence=Minor ID % 1000, whereby % represents the modulo operator; Location=Major ID/1000; and Sub-Location=Major ID % 1000.

If triangulation-based detection was used at step 10, the following steps may be performed to calculate the unique ID or IDs for the mobile device. The detected beacons are sorted based on the signal strength (like RSSI, transmission power, received power, etc.) in descending order. Beacons may be filtered, e.g., removed from the list, if their received signal strength indicator does not fall within a predetermined value, or if they proximity is unknown or if the azimuth and angle doesn't meet predetermined requirements or a combination of these. For example, if the signal strength is too weak, such as determined by comparing the signal strength to a predetermined threshold, the corresponding beacon may be removed from the list. Then, the top "x" beacons from the list are identified where x>1. In one example, x is greater than or equal to 3. If a plurality of beacons from the top "x" beacons have the required signal strength, then, the major ID and minor ID are used to calculate the Row, Sequence, Location and Sub-location information from the beacon signals, which is in turn is used to generate the unique ID or IDs. Beacons in the same lane may have the same location, sub location and row value.

If tap-based detection was used at step 10, then the following is performed with all the beacons that are found in range. At step 1, the beacons are sorted based on signal strength, accuracy, etc. in descending order and the first beacon in the list is identified or they are sorted in ascending order and the last beacon in the list is identified. Checks on the azimuth, angle, distance, accuracy are performed to ensure the mobile device is in the desired proximity of the beacon. At step 2, the signal strength value for this beacon should be greater than or equal to a predetermined value, e.g., <=−30 dB. At step 3, the row, location and sub-location information of the beacon is used to generate the unique ID or IDs.

One example of a unique ID calculation function for either tap-based detection or triangulation-based detection is: Unique ID=[Pre-defined Unique ID Part]+[Location]+[Sub location]+[Row]. In other examples, mathematical functions, such as a conventional hash function, RSA, etc., are employed that use these three values along with other values, to derive the unique ID or IDs. In other examples, mathematical functions can be used to determine these three values, which in turn become input to other mathematical functions to derive the unique ID or IDs. The input values may include current time, location, sub-location, row, sequence, etc.

At step 12 shown in FIG. 4, for message exchange, the mobile device and the zone computer at the sub-location, such as the zone computer for the lane, exchange information for validation. Regardless of the way detection and activation were performed, message exchange occurs in the same way. The zone computer determines whether the mobile device is within its area of validation if the mobile device is within range. FIG. 3 shows an example of an area of validation for a zone computer. To determine whether the mobile device is within the zone computer's area of validation, the zone computer may use the distance, signal strength, the azimuth and angle of the mobile device relative to the zone computer or plurality of these options to determine the mobile device's location.

The zone computer initiates a connection with the access control application on the mobile device if the mobile device is in the area of validation and the mobile device is broadcasting or advertising or transmitting one or more unique IDs and/or has predetermined services and/or characteristics. Then message exchange may occur for validation. For example, the zone computer and the access control application on the mobile device may perform a mutual authentication to establish the identity of both sides. After authentication, data is exchanged between the access control application and the zone computer for validation. The zone computer and the access control application may request additional data resulting in multiple exchanges. In another example, the mobile device may initiate the connection with the zone computer and then engage in authentication and then validation. Authentication in either case may include determination of keys for secure communication.

At step 13 shown in FIG. 4, validation is performed. Validation may be performed the same way regardless of how detection was performed. For example, the zone computer makes a decision on whether the user is validated based on data exchanged with the mobile device, equipment operational data, and/or real-time services hosted on a backend. The equipment operational data may include fare rules (different fare types, concession types, fare validity window, etc.), transfer rules, location information (e.g., zone computer location), user ID information which may be compared to a user list to determine whether the user should be blocked from entry, etc. The real-time services may include fare payment to enter or exit the restricted area 101. In another example, the backend may store authorization information for individuals to determine whether the user is cleared to enter the restricted area 101. The decision of whether the user is validated is communicated to the user, such as through a display, such as display 151*a* shown in FIG. 2, or through the mobile device, or through an audio notification from the zone computer and/or mobile device, or a haptic feedback (vibration) on the mobile device. For example, the zone computer may send information to the access control application related to the validation decision and/or the user's account (e.g., new balance, transaction summary, etc.). The access control application may communicate the decision to the user using inbuilt features like haptic feedback, audio notification, visual notification, etc., based on user's preferences. Also, the gate is opened if the user is validated to allow entry or exit. Or in a case of an always open gate, the gate is closed if the user is denied entry or exit.

FIG. 5 shows details of the steps of FIG. 4 and illustrates the interaction between the devices in the system 100 performing the steps. For example, assume user 131*a* is entering lane 110*a* and has mobile device 130*a* running access control application 132*a*, such as shown in FIGS. 1 and 2. The mobile device 130*a* interacts with beacons 140*a-d* and zone computer 150*a* when performing the steps.

The beacons 140*a-d* periodically broadcast their unique IDs and optional payload indicating location. At step A, the mobile device 130*a* receives the broadcasts when in range. At step B, if the access control application 132*a* isn't already running, the access control application 132*a* is launched for example if the operating system of the mobile device 130*a* recognizes the unique IDs of the beacons as registered unique IDs. For example, beacon IDs that have a predetermined UUID, major ID and/or minor ID invoke launching of the access control application 132*a*. If tap based detection is used for the beacons, the access control application 132*a* may be launched if the user taps on or near a beacon and the unique IDs of the beacon is registered. At step C, the access control application 132*a* enters detection mode to determine whether it is in a lane, such as lane 110*a*. Detection may include tap-based detection or triangulation-based detection. After detecting the mobile device 130*a* is in lane 110*a*, the access control application 132*a* enters activation mode to calculate the unique ID or IDs based on information from the beacons and a message with the unique ID or IDs may be broadcasted or sent to a local zone computer, e.g., zone computer 150*a*, at step E. For example, a mobile device unique ID, which includes the calculated unique ID or IDs, is broadcasted by the mobile device 130*a*. The broadcast may be a short range broadcast, such as using BLE, Bluetooth 4.0.

At step F, the zone computer 150*a* receives the broadcasted message with the mobile device unique ID from the mobile device 130*a* assuming it is within range, the zone computer 150*a* validates that the broadcasted message contains the unique ID or IDs related to the sub-location and determines whether the mobile device 130*a* is within the area of validation of the zone computer 150*a*. An example of the area of validation is shown in FIG. 3, such as the lane 110*a*. The zone computer 150*a* uses the distance, signal strength and optionally the azimuth and angle of the mobile device 130*a*, which may be determined from the received message, to determine whether the mobile device 130*a* is in its area of validation. For example, in addition to receiving the message from the mobile device 130*a*, the zone computer 150*a* may receive a message from a mobile device around the lane 110*b*. However, the zone computer 150*a* determines that only the mobile device 130*a* is currently in its area of validation, i.e., lane 110*a* or has the correct unique ID or IDs. Accordingly, the zone computer 150*a* will only communicate with the mobile device 130*a* for validation at this instant.

At step G, if the mobile device 130*a* is determined to be in lane 110*a*, the zone computer 150*a* initiates communication with the mobile device 130*a* using the unique ID or IDs as a reference. For example, the zone computer 150*a* sends an acknowledgment message to the mobile device 130*a* that includes the mobile device unique ID so the mobile device 130*a* knows that the zone computer is ready to proceed to validation. In another example, the zone computer 150*a* may broadcast or transmit an acknowledgment message that is encrypted with a key to the mobile device 130*a*. Only the mobile device 130*a* can decrypt the acknowledgment message sent from the zone computer 150*a* because no other mobile device knows the key. In yet another example, the zone computer 150*a* and the mobile device 130*a* calculate the mobile device unique ID independently using the same inputs and the same function. For example, the inputs for the unique ID calculation function described above may be determined by the mobile device 130*a* and broadcasted or sent to the zone computer 150*a* with the mobile device unique ID. Both the zone computer 150*a* and the mobile device 130*a* store the same function for calculating the mobile device unique ID. The zone computer 150*a* also calculates the mobile device unique ID. The zone computer 150*a* determines if the received mobile device ID matches the calculated mobile device ID to determine whether to continue with the process, e.g., initiate communication, authentication and validation.

Mutual authentication is performed at step H. The mobile device 130*a* and the zone computer 150*a* may exchange messages for authentication to establish identities of both sides. The mutual authentication might result in a generation of a key or set of keys that are then used for further encryption, decryption, enciphering, deciphering, etc. A conventional key encryption algorithm may be used.

At step I, the zone computer 150*a* determines whether the mobile device 130*a* or its user 131*a* is validated. Validation may include exchanging messages with a backend server not shown and/or the mobile device 130*a* to get the information needed to perform validation. In one example, validation may include a fare payment determination and the zone computer 150*a* may determine whether the fare can be paid from a user account for the user 131*a*. At step J, validation results are returned to the mobile device 130*a*. At step K, the zone computer 150*a* sends a signal to open gate 160*a* for the lane 110*a* if the user 131*a* is validated. The signal may be an internal signal if the gate 160*a* is part of the system 100 or it may be transmitted to an external system if the gate 160*a* is part of an external system. If the validation is denied, the zone computer 150*a* can display an indication on the display 151*a* that access to the restricted area is denied. If the user 131*a* is validated, the zone computer 150*a* can display an indication on the display 151*a* that the they are approved to access (or exit) the restricted area.

After steps E and F are performed, keys may be used for secure communication. As described above, the keys may be used to encrypt or encipher the messages between the mobile device 130*a* and the zone computer 150*a*. Accordingly, the key may be used for secure communication between the mobile device 130*a* and the zone computer 150*a*. Also, the mobile device unique ID and/or the key are run-time. For example, they may be generated in real-time for the validation process and are only valid for the current time and location and for the particular mobile device. This provides additional security by improving the robustness of the key. In another example, MACing might be used to secure the communication between the mobile device 130*a* and the zone computer 150*a*. In another example, both encryption and MACing might be used to secure the communication between the mobile device 130*a* and the zone computer 150*a*.

At step I, validation may vary depending on whether information for validation is stored locally or stored in a backend server. For example, for a "stored value" system, information for validation is stored locally on the mobile device in a secure manner. For example, information, such as user profile, balance amount, passes and concession information are stored securely on the mobile device. In a "credential" systems, the information is stored on a backend server (e.g., the cloud), and the mobile device only stores credentials, such as user account number, and the information is retrieved from the backend server in real time for completing validation or enforcement of transactions.

The information for validation, whether a "stored value" or a "credential" system is being used, can be encrypted and stored within a local data storage in the mobile device. In one example, the mobile device may not have the encryption key to decrypt the information and only the zone computer or computers may have access to the encryption key (or keys) to decrypt the data. Additionally, the encryption key may be derived by the zone computer or a secure storage (like a secure access module (SAM) or hardware security module (HSM) or a secure element running applets, connected to the zone computer) using the user's information as one of the inputs. Also, the encryption keys with which the data is encrypted and passed encrypted to the mobile device may be changed every time the user tries to access a restricted area to prevent tampering with the data. The mobile device does not have access to the key which protects the data.

The information related to user's account may be stored inside a secure storage area inside the mobile device (like a secure element, a secure element micro secure digital card, a universal integrated circuit card, a secure area within the application processor, etc.). This may involve an additional authentication performed between the zone computer and the secure storage, establishing the identity of both sides, resulting which the information is shared by the secure storage with the zone computer via the validator mobile application.

Also, one or more keys may be used to encrypt the communication between the secure storage and the zone computer. Additional keys may be generated during mutual authentication, which are then be used for encryption for the current session only.

In another example, the information related to user's account is stored in the backend server and can be securely accessed and updated by either the mobile device or by the zone computers or both. The mobile device only stores the user's credentials which may be a user ID, account number, or a similar unique identifier which can be used to access the user's information from the backend server in real time.

Figure 6:
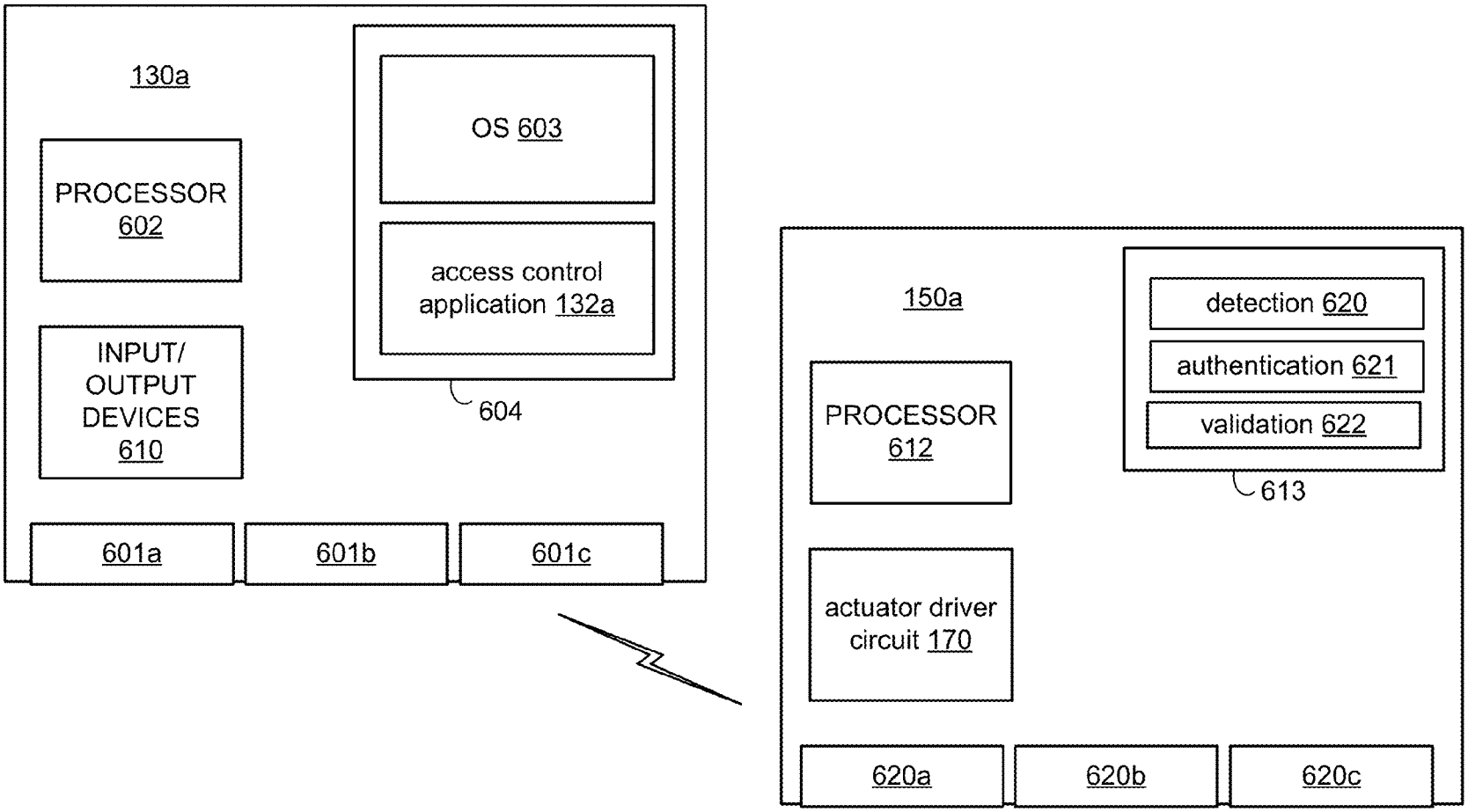
FIG. 6 illustrates a block diagram of the secure short-distance-based communication and access control system, according to an example of the present disclosure.

FIG. 6 shows a block diagram of the mobile device 130*a* and the zone computer 150*a* in the system 100 but is representative of any of the mobile devices and the zone computers that may be used in the system 100.

The mobile device 130*a* may include multiple interfaces 601, wired or wireless, for communicating with other devices. For example, interface 601*a* may be a Wi-Fi interface or a cellular interface or may include both interfaces. 601*b* may include a Bluetooth interface. In one example, message exchanges between the mobile device 130*a* and the zone computer 150*a* are done through Bluetooth or Bluetooth 4.0 or BLE or future versions of Bluetooth but other interfaces may be used. Interface 601*c* may be a NFC interface, but the mobile device 130*a* may have both Bluetooth and NFC interfaces and multiple other interfaces. Interface 601*b* may be for communicating with the beacons 140, for example, for triangulation-based or tap-based detection.

The mobile device 130*a* includes a processor 602 and data storage 604. The processor 602 for example is an integrated circuit. The processor 602 may be a chipset with central processing unit and/or custom processing circuits, such as an application-specific integrated circuit (ASIC) or field-programmable gate array (FPGA). The processor 602 may run an operating system (OS) 603 and applications, including access control application 132*a*, for the mobile device 130*a*. The OS 603 and the applications are stored in data storage 604. The mobile device 130*a* includes input/output (I/O) devices 610, such as keyboard, touch screen display, speaker, etc. The I/O devices 610 may provide audio, visual and/or tactile output to indicate whether a user has been validated and allowed access to the restricted area 101 or whether the user is denied access.

The zone computer 150*a* includes a processor 612 and a data storage 613. The processor 612 is an integrated circuit. The processor may execute software or firmware or comprise custom processing circuits, such as an application-specific integrated circuit (ASIC) or field-programmable gate array (FPGA). The data storage includes software or firmware including machine readable instructions. The software or firmware may include subroutines or applications for detection 620, authentication 621 and validation 622. The detection 620 includes determining when a mobile device is in the area of validation for the zone computer 150. Authentication 621 and validation 622 are described above and are for authenticating the mobile device 130*a* before communicating with it and validating the mobile device 130*a* to allow or deny access to the restricted area 101. The zone computer 150*a* may include I/O devices or be connected to an I/O device, such as display 151*a*, to provide indication to the user of whether they are validated.

The zone computer 150*a* also includes multiple interfaces 620, wired or wireless, for communicating with other devices. For example, interface 620*a* may be a Wi-Fi interface or a cellular interface or may include both interfaces. 620*b* may include a Bluetooth or Bluetooth 4.0 or BLE interface. In one example, message exchanges between the mobile device 130*a* and the zone computer 150*a* are done through a Bluetooth but other interfaces may be used. 620*c* may be a NFC interface, but the mobile device 130*a* may have both BLE and NFC interfaces. The interfaces 620*b* and 620*c* are short-distance communication interfaces. A short-distance communication interface may have a communication range of few meters (e.g., Bluetooth or BLE) or centimeters (e.g., NFC). The range is generally much shorter than Wi-Fi or cellular. The short-distance communication interface may cover a sub-location or a sub-location and its adjacent sub-location. The zone computer 150*a* may connect via a network interface of interfaces 620 to a server backend via the Internet or another wide area network or a local area network for validation, which may include fare payment.

The zone computer 150*a* may include an actuator driver circuit 170 to control actuation of the physical barrier for the sub-location of the zone computer. In response to determining the user is validated, the zone computer 150*a* sends a signal to the actuator driver circuit 170 to invoke opening of the physical barrier, such as gate 160*a*, for the sub-location, such as lane 110*a*, of the zone computer 150*a*. For example, the processor 612 validates a user associated with the mobile device 130*a* and sends a signal to the actuator driver circuit 170. The actuator driver circuit 170 drives an actuator of the gate 160*a* to open the gate 160*a*. The processor 612 may also drive the circuit 170 to close the gate 160*a*. In one example, the global positioning system (GPS) sensor on the mobile device may be used to determine when the user enters and exits the mass transit system in order to determine the fare amount and open the gate 160*a* if the fare is paid when the user is exiting.

Figure 7:
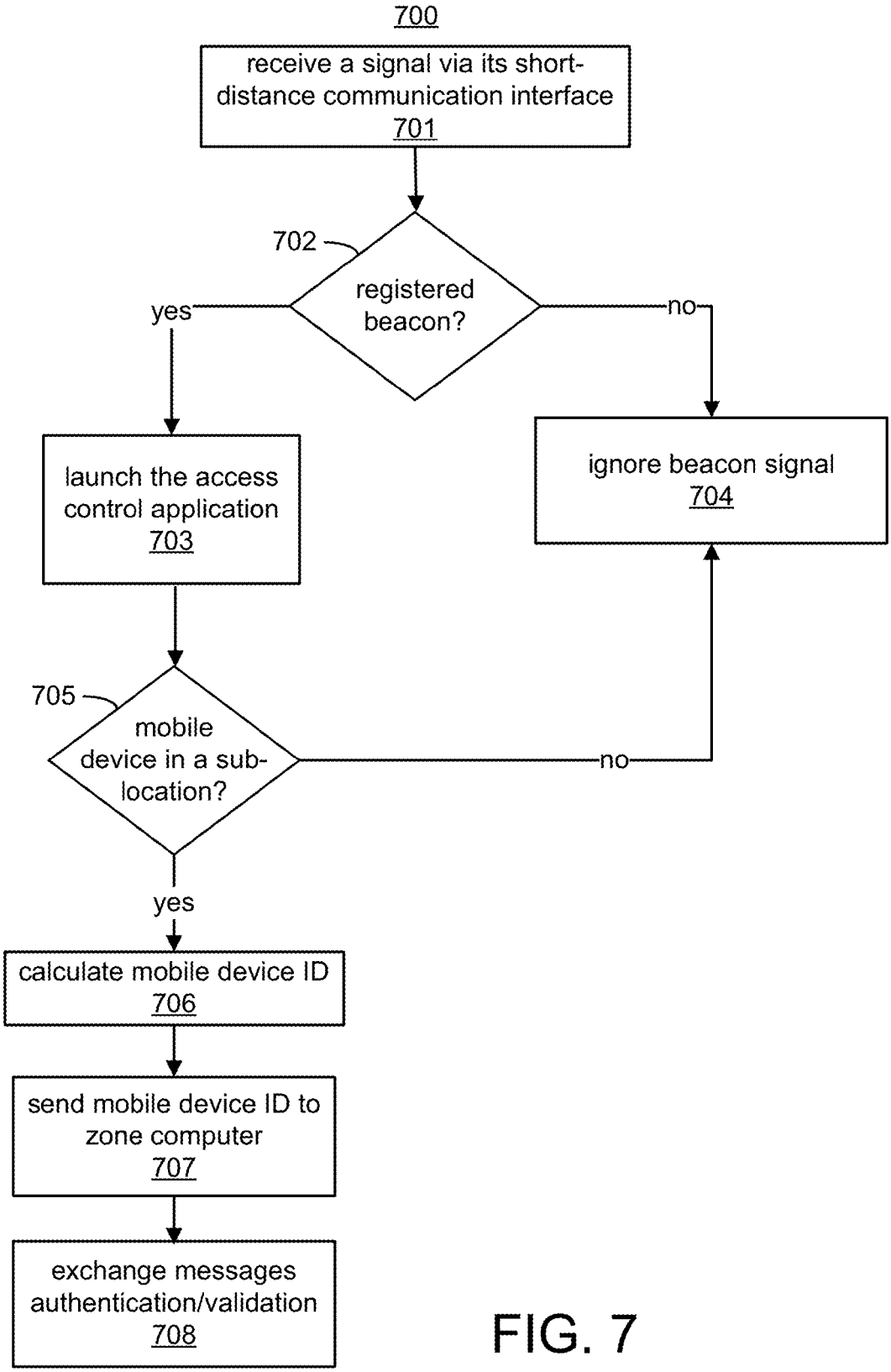
FIGS. 7 and 8 illustrate flowcharts of methods performed by a mobile device and zone computer in the secure short-distance-based communication and access control system, according to examples of the present disclosure.

FIG. 7 shows a flowchart of a method 700 that may be performed by a mobile device, such as the mobile device 130*a*, in the system 100. At 701, the mobile device 130*a* receives a signal via its short-distance communication interface, such as a Bluetooth, BLE or Bluetooth 4.0, interface. At 702, the mobile device 130*a* determines whether it is from at least one registered beacon. For example, the OS 603 running on the mobile device 130*a* determines whether the unique IDs, like UUID, major ID and/or minor ID received from a beacon or a plurality of beacons matches one or more registered unique IDs. At 703, if the beacon or beacons are registered beacons, the OS 603 launches the access control application 132*a*. If not, the received signals are ignored at 704.

At 705, the access control application 132*a* determines whether the mobile device 130*a* is in a sub-location, e.g., lane 110*a*, of the access control area 102. This may be determined by triangulation-based detection or tap-based detection as described above. If the mobile device 130*a* is determined to be in a sub-location, a mobile device ID is calculated based on information received from the one or more beacons at 706. The mobile device ID may be unique to the current location of the mobile device 130*a* when the mobile device ID is calculated and subsequently broadcasted in a message, which may be received by the zone computer 150*a* at 707 assuming it is within range. If the mobile device 130*a* is not determined to be in a sub-location, the signals from the beacons are ignored at 704. At 708, messages are exchanged with the zone computer 150*a* for the sub-location in a secure manner using one or more encryption keys via a short-distance communication interface (e.g., Bluetooth) to mutually authenticate each other and validate a user associated with the mobile device and to allow access to the restricted area through the sub-location if the user is validated.

Figure 8:
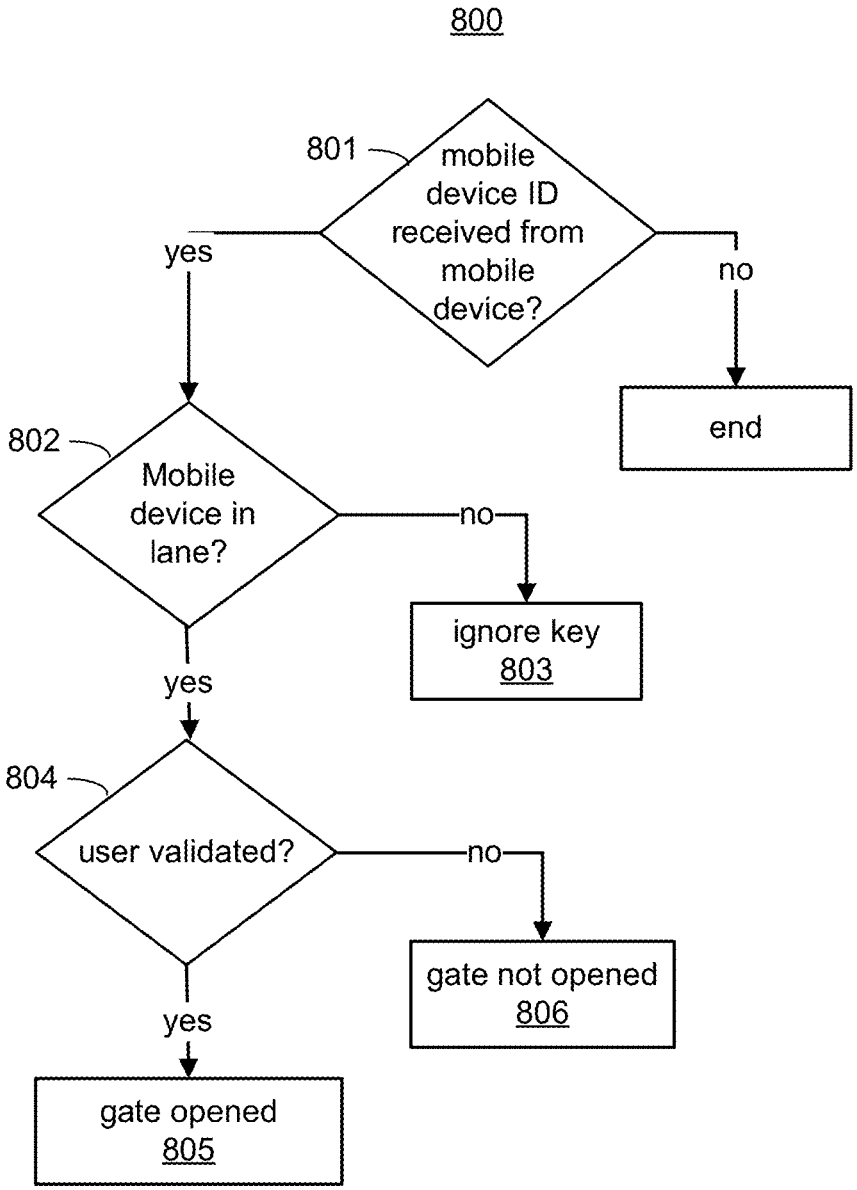

FIG. 8 shows a flowchart of a method 800 that may be performed by a zone computer, such as the zone computer 150*a*, in the system 100. At 801, the zone computer 150*a* determines whether a mobile device ID is received in a message from the mobile device 130*a* via a short-distance communication interface of the zone computer 150*a*. If the mobile device ID is received, the zone computer 150*a* determines whether the mobile device 130*a* is in lane 110*a* at 802. If tap-based detection was used, the zone computer 150*a* can determine the proximity of the user to the lane 110*a*. Alternatively, the zone computer 150*a* may scan for all Bluetooth mobile devices in range looking for devices which expose certain services/characteristics, and determines a mobile device is in the lane 110*a* based on the signal strength, dwell time, accuracy, distance, azimuth, angle, etc.

At 803, if the mobile device 130*a* is not determined to be in lane 110*a*, the message is ignored. If the mobile device 130*a* is determined to be in lane 110*a*, the zone computer 150*a* determines whether a user associated with the mobile device 130*a* is validated to access the restricted area at 804. At 805, the zone computer 150*a* for example opens the gate 160*a* for lane 110*a*, and sends a message to the mobile device 130*a* that the user is validated if the user is determined to be validated. Otherwise, at 806, the gate 160*a* is not open and a message is sent indicating validation failure. Validation results may also be displayed on display 151*a*.

Figure 9:
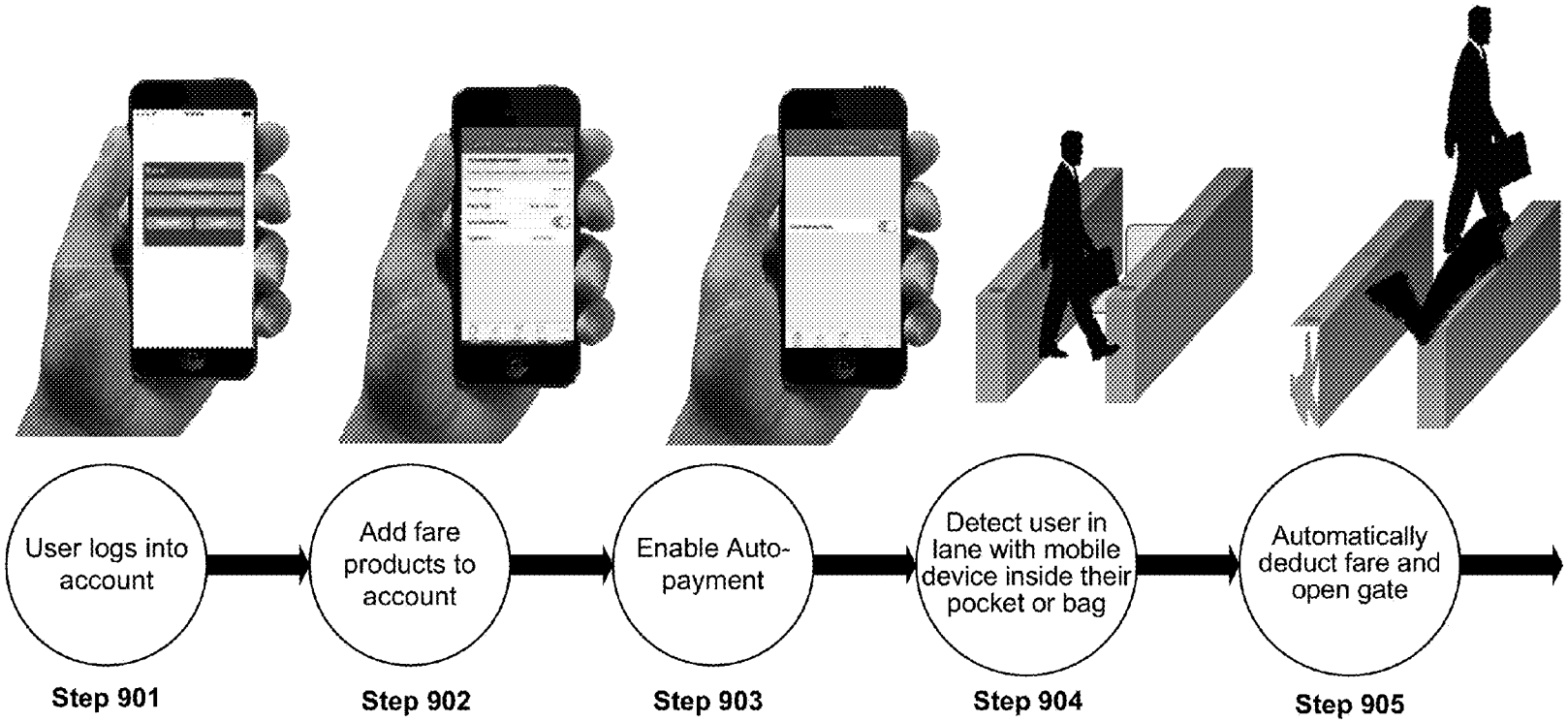
FIG. 9 illustrates a method for fare-based validation, according to an example of the present disclosure.

FIG. 9 illustrates a method 900 for fare-based access control using the system 100. For example, validation and approval or denying entry or exit to a restricted area is based fare payment. The restricted area 101 for example provides a fare-based service, such as a subway or rail station that charges a fare to passengers that ride the train. Also, the access control application 132*a* includes modules to enable fare payment.

At 901, a user logs into their account. The user may have to create an account if they don't have one. The access control application 132*a* provides a graphical user interface on the mobile device 130*a* to receive a login ID and password and send the information to a backend server to log the user into their account. At 902, the access control application 132*a* adds fare products to the account based on user selections. Fare products includes any goods or services for which the user is authorizing payment. At 903, the access control application 132*a* enables auto-payment of the selected fare products in response to user input. At 904, the mobile device is detected in a fare-gate lane, such as lane 110*a*. Detection of the mobile device 130*a* in lane 110*a* to invoke validation is described in detail above. Validation is the payment of the fare in this example. The mobile device 130*a* may remain in the user's pocket or bag to invoke validation, which is more convenient for the user. At 905, the user's account is automatically deducted and the fare gate opens. The amount deducted is based on the fare scheme used by the transit entity, which may be based on distance, day pass, etc.

What has been described and illustrated herein is an example along with some of its variations. The terms, descriptions and figures used herein are set forth by way of illustration only and are not meant as limitations. Many variations are possible within the spirit and scope of the subject matter, which is intended to be defined by the following claims—and their equivalents—in which all terms are meant in their broadest reasonable sense unless otherwise indicated.

What is claimed is:

1. A secure short-distance-based communication and access control system to control access to a restricted area, the system comprising:

a plurality of electronically-controlled movable physical barriers, wherein each electronically-controlled movable physical barrier is located in a different sub-location of a plurality of sub-locations of an access control area associated with the restricted area;

at least one beacon for each sub-location, wherein each beacon broadcasts a beacon ID, including one or more unique identifiers, in its sub-location; and a zone computer associated with a different sub-location of the plurality of sub-locations, wherein the zone computer comprises:

an actuator driver circuit to control actuation of the physical barrier for the sub-location of the zone computer;

a short-distance communication interface to communicate with a mobile device if the mobile device is in the sub-location of the zone computer; and a processor to:

receive a mobile device identifier from the mobile device via the short-distance communication interface, wherein the mobile device identifier is based on the beacon identifier included in the broadcasted signal;

determine a proximity of the mobile device to a sub-location of the plurality of sub-locations;

determine whether the mobile device is in the sub-location of the zone computer based on the determined proximity of the mobile device to the sub-location in response to a determination that the mobile device is in the sub-location of the zone computer, determine whether a user associated with the mobile device is validated to access the restricted area, and in response to determining the user is validated, send a signal to the actuator driver circuit to invoke opening or closing of the physical barrier for the sub-location of the zone computer.

2. The secure short-distance-based communication and access control system of claim 1, wherein the received mobile device identifier is unique to a current location of the mobile device when the mobile device transmits the mobile device identifier to the zone computer of the sub-location where the mobile device is located.

3. The secure short-distance-based communication and access control system of claim 1, wherein the processor uses one or more encryption keys to securely transmit messages to the mobile device in response to determining the mobile device is in the sub-location of the zone computer.

4. The secure short-distance-based communication and access control system of claim 3, wherein the securely transmitted messages authenticate the mobile device and the zone computer.

5. The secure short-distance-based communication and access control system of claim 4, wherein if the mobile device is authenticated, the securely transmitted messages include messages for validating the mobile device.

6. The secure short-distance-based communication and access control system of claim 3, wherein to securely transmit the messages to the mobile device, the processor encrypts the messages with the one or more encryption keys.

7. The secure short-distance-based communication and access control system of claim 1, wherein a fare associated with accessing the restricted area is paid from a user account to validate the user.

8. The secure short-distance-based communication and access control system of claim 7, wherein the zone computer comprises a network interface, and the zone computer communicates with a backend server via the network interface to validate the user.

9. The secure short-distance-based communication and access control system of claim 1, wherein a range of the short distance communication interface includes the sub-location of the zone computer and an adjacent sub-location.

10. The secure short-distance-based communication and access control system of claim 1, wherein the system controls entry or exit to the restricted area at each sub-location, and the control is independent for each sub-location.

11. A mobile device comprising:

at least one short-distance communication interface to receive a beacon identifier (ID) from at least one beacon;

a data storage storing an operating system and an access control application;

a processor executing the operating system, wherein the operating system determines whether the received beacon ID is a registered beacon identifier, and in response to determining the received beacon ID is registered, launches the access control application;

the access control application, in response to being launched, is executed by the processor, the access control application to:

determine whether the mobile device is at a sub-location of an access control area associated with a restricted area, wherein the access control area includes a plurality of sub-locations, in response to a determination that the mobile device is at the sub-location, calculate a mobile device identifier (ID) for the mobile device based on the beacon ID, wherein the mobile device ID is valid for the sub-location where the mobile device is currently located, and is not valid for any sub-location where the mobile device is not currently located, engage in secure communication with a zone computer for the sub-location using one or more keys via the at least one short-distance communication interface, wherein to engage in secure communications with the zone computer, the access control application causes the processor to:

send the calculated mobile device identifier to the zone computer;

validate a user associated with the mobile device; and allow access to the restricted area through the sub-location if the user is validated.

12. The mobile device of claim 11, wherein the mobile device ID is calculated based on at least one of a signal strength of a received signal from the at least one beacon, a major ID of the beacon ID, and a minor ID of the beacon ID.

13. The mobile device of claim 11, wherein the zone computer engages in the communication with the mobile device if the zone computer determines the mobile device is currently located in a sub-location associated with the mobile device.

14. The mobile device of claim 11, wherein the mobile device includes an input/output (I/O) device, and the access control application receives a message from the zone computer indicating whether the user is validated, and generates an indication of whether the user is validated through the I/O device.

15. The mobile device of claim 11, wherein to determine whether the mobile device is at the sub-location, the access control application executes tap-based detection by receiving a signal from one or more beacons associated with the sub-location and determining from the received signal whether the mobile device is in the sub-location.

16. The mobile device of claim 11, wherein to determine whether the mobile device is at the sub-location, the access control application executing triangulation-based detection by receiving signals from at least two beacons associated with the sub-location and determining from the received signals whether the mobile device is in the sub-location.

17. A mobile device activation and validation method comprising:

receiving a signal via at least one short-distance communication interface of a mobile device;

determining, by an operating system running on the mobile device, whether the signal is from a registered beacon;

in response to determining the signal is from a registered beacon, launching an access control application stored on the mobile device;

determining whether the mobile device is at a sub-location of an access control area associated with a restricted area based on information in the received signal;

in response to determining the mobile device is at the sub-location, calculating a mobile device identifier (ID), wherein the mobile device ID is valid for a current location of the mobile device and is not valid for locations other than the current location; and exchanging messages with a zone computer for the sub-location in a secure manner using one or more keys via the at least one short-distance communication interface to validate a user associated with the mobile device and to allow access to the restricted area through the sub-location if the user is validated, wherein exchanging messages with the zone computer includes the access control application sending the calculated mobile device identifier to the zone computer.

18. The mobile device activation and validation method of claim 17, comprising:

logging in the user to the access control application;

adding monetary value to an account of the user;

enabling auto-payment; and exchanging the messages with the zone computer to validate the user includes exchanging the messages to debit a fare from the account of the user, wherein entry to the restricted area or exit from the restricted area is allowed in response to debiting the fare from the account or in response to determining the account is enabled to debit the fare.

19. The method of claim 17, comprising:

the mobile device transmitting information including at least one services provided by the mobile device and characteristics of the mobile device, wherein the zone computer for the sub-location receives the information, determines whether the mobile device is within its area of validation and initiates the exchange of the messages if the mobile device is within its area of validation.

20. The method of claim 17, comprising:

after determining the mobile device ID, the mobile device determining if the zone computer is transmitting a services message with the mobile device ID or has services and/or characteristics with the mobile device ID, and if the mobile device receives the services message with the mobile device ID, initiating the exchange of the messages if the zone computer is within its area of validation.

21. A method to control access to a restricted area, the method comprising:

determining whether a mobile device is in a sub-location associated with a zone computer;

determining whether a mobile device identifier is received from the mobile device via a short-distance communication interface of the zone computer, wherein the mobile device identifier is determined based on broadcasted signals received from at least one beacon for the sub-location associated with the zone computer;

in response to determining the mobile device is in the sub-location associated with the zone computer, and further in response to determining the mobile device identifier is received, determining whether a user associated with the mobile device is validated to access the restricted area, and communicating a result of the validation determination to the mobile device via the short distance interface, wherein determining whether the user is validated and communicating the result of the validation comprises securely exchanging messages with the mobile device using one or more keys, and the one or more keys are unique to a current location of the mobile device at the sub-location and valid for a current time only.

22. The method of claim 21, wherein determining whether the user is validated comprises:

receiving one or more messages from the mobile device to invoke debiting a fare from an account of the user, wherein entry to the restricted area or exit from the restricted area is allowed in response to debiting the fare from the account or in response to determining the account is enabled to debit the fare.

* * * * *